United States Patent [19]

Fuller et al.

[11] Patent Number: 4,848,649

[45] Date of Patent: Jul. 18, 1989

[54] PACKAGE WITH TEAR OPENING STRIP DEVICE

[75] Inventors: Anthony T. B. Fuller, Gerrards Cross; Arthur N. Jones, Jordans, both of England

[73] Assignee: Koninklijke Embalage Industrie Van Leer BV, Buckinghamshire, England

[21] Appl. No.: 205,386

[22] Filed: Jun. 10, 1988

[51] Int. Cl.[4] ..... B65D 55/06

[52] U.S. Cl. ..... 229/123.2; 206/605; 206/616; 206/617; 229/125.35

[58] Field of Search ..... 206/605, 616, 617; 229/123.2, 125.35

[56] References Cited

U.S. PATENT DOCUMENTS

| | | | |
|---|---|---|---|
| 3,115,245 | 12/1963 | Schechter | 206/616 |
| 3,194,479 | 7/1965 | Rumberger | 229/123.2 |
| 3,873,735 | 3/1975 | Chalin et al. | 206/605 X |
| 4,091,930 | 5/1978 | Buchner et al. | 206/605 |
| 4,337,284 | 6/1982 | Cooper et al. | 206/605 |
| 4,351,473 | 9/1982 | Manizza | 229/123.2 |
| 4,438,850 | 3/1984 | Kahn | 229/123.2 X |

*Primary Examiner*—Stephen Marcus
*Assistant Examiner*—Kathryn M. Stemann
*Attorney, Agent, or Firm*—Connolly & Hutz

[57] ABSTRACT

A package for foods is disclosed and comprises a container having a peripheral flange at its mouth. The container is made of or lined with a plastics material so as to provide a plastics surface at the flange. The container is covered by a lid which is heat-sealed to the flange. In order to be able to open the package easily, especially when it is hot, a tear-strip of material extends across at least the flange and is secured to the lid by a heat seal. The tear-strip presents a tab for engagement by the fingers of a user, and, in order to ensure that the lid can be torn effectively by the tear-strip, the bond between the tear-strip and the lid is chosen to be at least as strong as the bond between the lid and the flange.

9 Claims, 3 Drawing Sheets

PACKAGE WITH TEAR OPENING STRIP DEVICE

This invention relates to packaging and is concerned with the packaging of frozen, chilled or fresh foods in packages which can be subjected to heat to cook or heat the goods and which can be easily opened.

Many food items nowadays are packaged in containers or trays which are covered with a lid of plastics material which is usually transparent so that the contents of the package are visible to the purchaser. This is particularly the case for frozen or chilled meals or dishes which have to be heated to cook or heat the meals. The packages comprise a plastics or fibre material container or tray which is flanged at the edges, with a lid of plastics material secured to the flange of the container or tray.

However, problems arise with such packages, because the bond between the lid and the flange has to be sufficiently strong to prevent the ingress of air or leakage of any liquid in the package and to resist the effect of any liquid in the package which might destroy or adversely affect an adhesive bond. Furthermore, since the packages are to be heated in an oven or microwave oven, the bond must be able to resist the heat and any adhesive must not develop noxious fumes or odours on heating.

However, the use of such a strong bond means that the lid of the package cannot be easily removed when necessary and has to be cut out.

Various combinations of materials for the trays and lids have been proposed but none has proved entirely satisfactory in practice as regards ease of opening and where trays of fibre material have been used which are lined with a plastics layer, the bond can be so strong that when the lid is removed as by pulling, the plastics lining is also removed so that the contents of the package are presented in a pouch.

It is an object of the invention to provide a packaging which can be readily opened.

According to the present invention there is provided a package comprising a tray or like container the mouth of which is formed with a peripheral flange and made of or lined with a plastics material, and a lid which is heat-sealed to the flange of the tray or container, characterised in that a tear-strip of material extends across at least the flange of the tray or container and is secured to the lid by a heat-seal, with a portion of the tear-strip material being presented for engagement by the fingers of a user, and in that the bond between the tear-strip and the lid is at least as strong as the bond between the lid and the flange.

The lid and tear-strip may each comprise a layer of plastics material and in this case the tear-strip can be provided below the lid. The tear-strip and lid are bonded by being heat-sealed in an A to B sealing mode (as explained hereinafter), and for this reason the bond between the tear-strip and the flange is the same as the bond between the lid and the flange and the same as the bond between the tear-strip and the lid and will therefore not be stronger than the bond between the lid and the flange.

However, where the tear strip is made of paper and the lid is also made of paper then it is necessary to interpose a strip of heat-sealing material between the tear-strip and the lid. If the tear-strip has a strip of heat-sealing material on one side only, then the tear-strip has to be provided on top of the lid, since if it were below, the bond obtained between the plastics of the container or its lining and the paper of the tear-strip would be stronger than the bond between the tear-strip and the lid, so that the portion of the tear-strip presented for engagement by the fingers of the user would merely break off when pulled. However, if the paper tear-strip is provided on both sides with a strip of heat-sealing material it will be possible to provide such a tear-strip below the lid.

In either case, an appropriate choice of materials is made for the plastics of the tray or its lining, the lid, the tear-strip material and any heat-sealing material to ensure that, upon pulling the tear-strip, the lid is torn open.

By pulling upon the tear-strip the user can readily open the package and, in some cases, once the tearing of the lid has started the tearing will also occur at the inner edge of the flange. This may occur due to the tear propagation properties of the lid material, to the formation of a bead of amorphous material at the inner side of the flange during heat-sealing, to weakening of the lid at the flange as the result of any steam generated when heating the package or to a combination of two or more of these causes.

In order to enable the invention to be more readily understood, reference will now be made to the accompanying drawings, which illustrate diagrammatically and by way of example some embodiments thereof, and in which.

Figure 1:
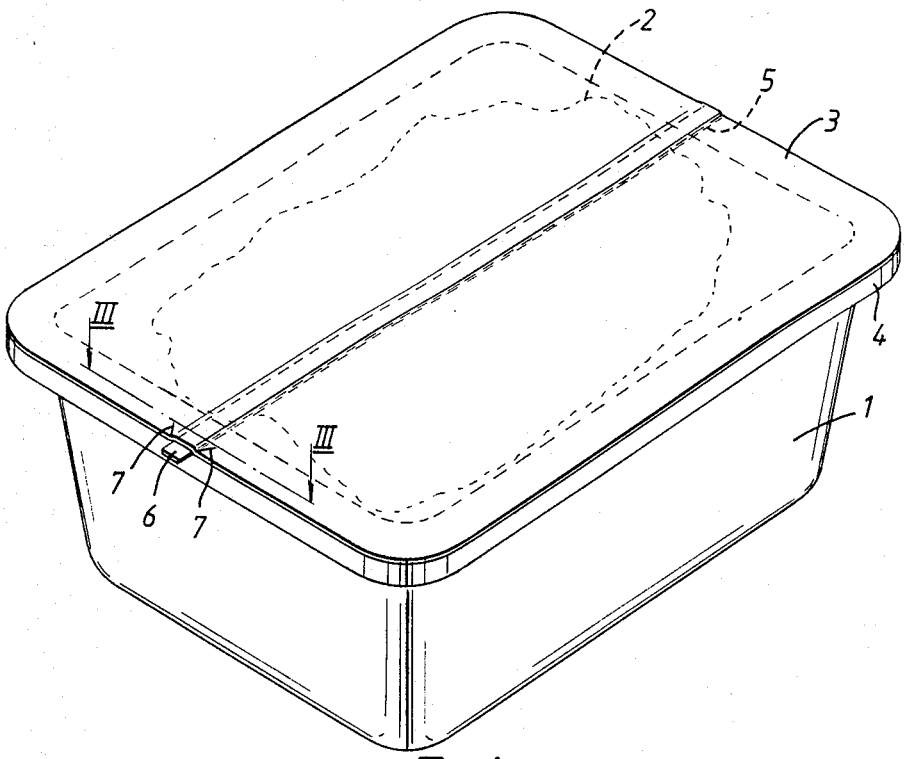
FIG. 1 is a perspective view of a package in accordance with the invention.
Figure 2:
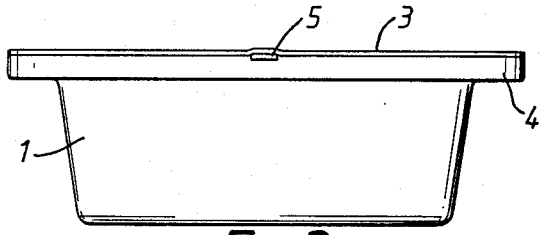
FIG. 2 is an end view of the package shown in FIG. 1.
Figure 3:
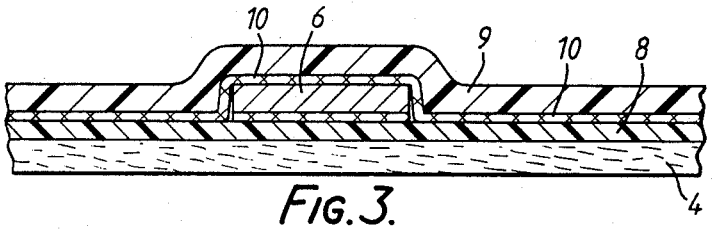
FIG. 3 is an enlarged schematic section along the line III—III in FIG. 1.

Referring now to FIGS. 1 to 3 of the drawings, there is shown a package comprising a flanged tray 1 made of moulded fibre pulp and lined with lining 8 (see FIG. 3) of polyethylene terephthalate of 36 microns thickness. The tray contains chilled food indicated at 2, and is covered by a lid 3 of a plastics material sold under the Registered Trade Mark "Melinex 850". The material "Melinex 850" is a co-extruded plastics film comprising a layer of polyester and a layer of a heat-seal material which is present at a rate of 4 to 5 g/m$^2$. The lid is about 30 microns thick and has been heat-sealed to the tray lining at the flange 4 of the tray. A tear strip 5 of "Melinex 850" is incorporated in the lid, having been heat-sealed thereto in an A to B sealing mode. A tab 6 of the tear strip material projects at one end of the package and two small cuts or nicks 7 are made in the lid on either side of the tear strip 5.

FIG. 3 shows in detail the tear-strip 5 at the flange 4 of the tray. It will be seen that the flange 4 has a lining 8 of polyethylene terephthalate and the lid and tear-strip are both formed of the plastics material sold under the Registered Trade Mark "Melinex 850" which is a co-extruded plastics film 30 microns thick composing a layer 9 of polyester and a layer 10 of a heat-seal material present at a rate of 4 to 5 g/m$^2$. It will be noticed that in each case the bond between the lid and the tear-strip and the lid and the flange of the tray is by means of the heat-seal material 10 so that the bonds are of comparable strength.

When it is desired to open the package, the tab 6 is gripped and pulled back across the package, the nicks 7 ensuring that the tearing commences in the right direction and facilitating further tearing. However, in many cases it is found that instead of tearing the package straight across, tearing starts at the inner edge of the flange 4 as a result of tear propagation so that the whole lid may be removed at one go. This of course is particularly desirable when the package and its contents are hot.

In making the package, the package lining may be applied by a vacuum-forming technique and the lidding material may be prepared by unrolling a roll of the "Melinex 850" and passing it through a heat-sealing station together with a strip of "Melinex 850" so that the polyester layer 9 of the strip is heat sealed to the heat-seal layer 10 of the roll so that there is substantially no discontinuity in the coating of the coated side of the lidding material. That is to say the strip is heat-sealed to the roll in an A to B sealing mode so that a fused solid homogeneous structure at the seal is obtained. The lidding material is then applied to the tray, after the latter has been filled, and is heat-sealed to the flange of the tray.

The heat-sealing is effected by pressing a heat-sealing tool onto the flange of the tray. As a result of this pressure and heat some of the lidding material and possibly some of the tray lining (or tray if the tray is of plastics material) is squeezed towards the interior of the tray to form a bead of substantially amorphous material around the shoulder at the inner side of the flange. This bead of amorphous material acts as a line of weakness to enable the lidding material to be removed easily even if the removal of the tear strip has only left an open slot across the package. By altering the shape or pressure of the heat-sealing tool it is possible to affect the formation and/or shape of this bead to facilitate opening of the package as desired.

It will be appreciated that many variations in the shape and materials of the package are possible and the tear strip may be present near to one edge of the package rather than across the middle as shown. While it might be possible to employ a short piece of tear strip material extending across one flange, it is preferable for the tear strip to extend across the package as shown. This also makes it more convenient to incorporate the tear strip in the lidding material using the method indicated above.

The lidding material must also be capable of withstanding the oven heat and of being heat-sealed to the plastics material of the container or its lining, so as to provide a good seal all around the flange of the container. Preferably it is also one which is capable of being heat-sealed to itself in an A to B sealing mode and the tear-strip material is therefore preferably also of the same material and of the same thickness as the lidding material. While other materials may possibly be usable for the tear strip, it is preferred that the tear strip material and the lidding material are the same so as to avoid the risk of any discontinuity in the seal of the lid to the container. For example, instead of making the tear-strip and lid of the aforesaid "Melinex 850", it is possible to use a material comprising a polyester with a heat-seal coating of either an acrylic coating or of a different polyester. The lidding material and tear strip conveniently have a thickness of from 12 to 50 microns.

Instead of using plastics material as the lidding material, it is also possible to use paper and some embodiments using paper as the lidding material will now be described.

Figure 4:
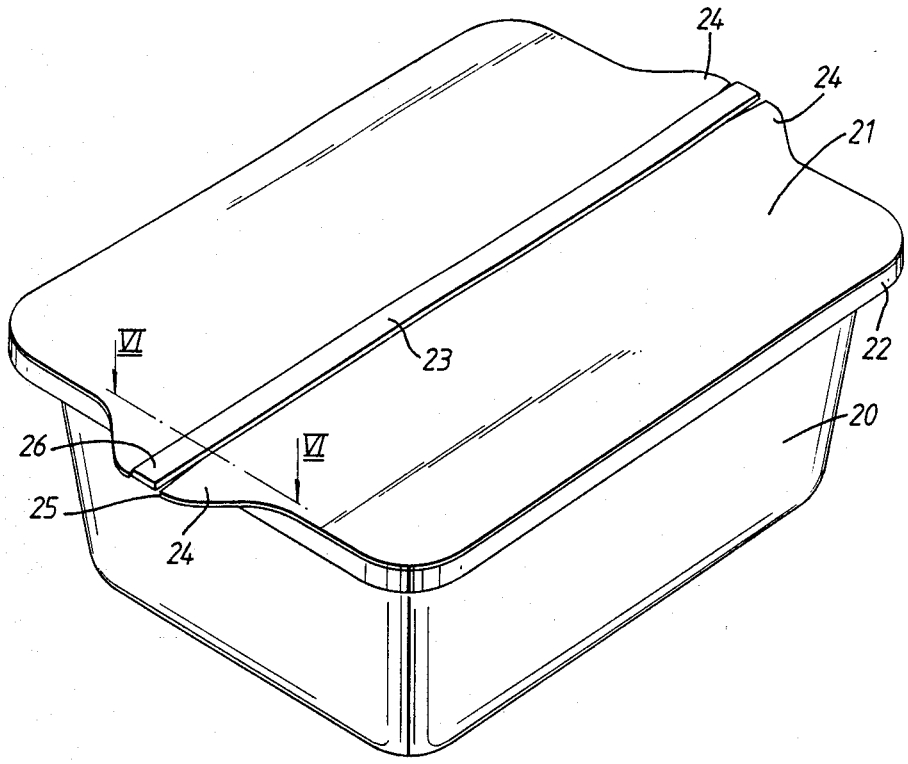
FIG. 4 is a perspective view of another package in accordance with the invention.
Figure 5:
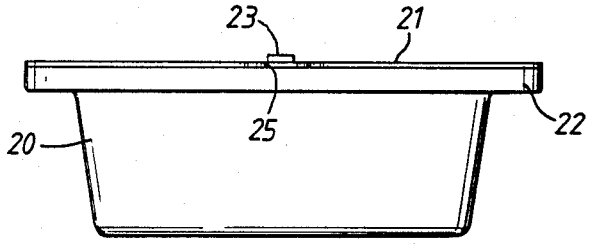
FIG. 5 is an end view of the package shown in FIG. 4.
Figure 6:
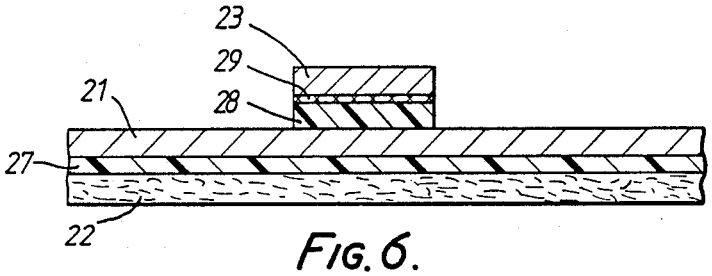
FIG. 6 is an enlarged schematic section along the line VI—VI in FIG. 4 and, FIG. 7 is a view similar to FIGS. 3 and 6 of part of another package.

Referring now to FIGS. 4 to 6 of the drawings, there is shown a package comprising a flanged tray 20 made of moulded fibre pulp and lined with a lining 27 (see FIG. 6) of nylon of 80 microns thickness. The tray is covered by a lid 21 of paper having a base weight of 59 $g/m^2$ and contains chilled food which is not visible through the lid. The lid 21 has been heat-sealed to the tray lining at the flange 22 of the tray. A tear-strip 23 of paper has been heat-sealed to the material of the lid by the interposition of a strip of acrylic coated polyethylene terephthalate and extends across the lid which at each end is formed with tab-like projections 24 which are separated from the tear-strip by cuts or nicks 25.

When it is desired to open the package, the end 26 of the tear-strip is gripped and pulled back across the package, the nicks 25 ensuring that the tearing commences in the right direction and facilitating further tearing. The lid of the package is thus torn right across and the remainder of the lid can be readily removed if it has not already torn away from the shoulder at the flange for one or more of the reasons indicated above.

FIG. 6 shows the tear-strip 23 at the flange of the tray. The flange 22 has a lining of nylon 27 and the lid 21 is heat sealed to the nylon by fusion of the nylon. Interposed between the lid 21 and the paper tear-strip 23 is a strip 28 of cast polyethylene terephthalate having on one face an acrylic coating 29. In a first stage, the strip 28 is sealed by its acrylic coating to the paper tear-strip 23 using, for example, impulse sealing and in a second stage the strip 28 is heat-sealed directly to the paper of the lid 21. The heat-seal bond between the strip 28 and the lid 21 is at least as strong as the bond between the lid 21 and the nylon lining 27 so that removal of the lid by the tear-strip is possible.

Figure 7:
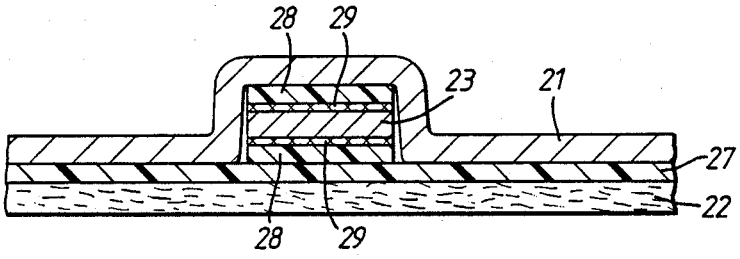

FIG. 7 shows the arrangement of a paper tear-strip 23 placed below a paper lid 21. In this case it is necessary that paper tear-strip 23 is sealed on both sides to a strip 28 of cast polyethylene terephthalate by an acrylic coating 29. In this case the bond between the upper strip 28 and the paper lid 21 is at least as strong as the bond between the lower strip 28 and the nylon lining.

In making the packages shown in FIGS. 4 to 7, a reel of paper to form the lid is unwound and brought into contact with the tear-strip material which is unwound from a separate reel and comprises a strip of paper 23, sealed by the coating 29 to the strip 28. The lidding paper and the strip 28 are contacted under heat-sealing to unite the tear-strip to the lidding paper. At the same time a loop is formed in the tear-strip material, the loop not being sealed to the lidding paper. After sealing the tear-strip to the lidding paper, the lidding paper is then heat-sealed to the flange 22 of the tray so that a loop of the tear-strip material lies at each end of the tray. After lidding, the lid and tear-strip are cut by shaped cutters to provide the package shown in FIG. 4.

It will be appreciated that by appropriate choice of materials and shapes a variety of easily opened packages can be prepared in accordance with the present invention.

The trays or containers of the present package may be formed of moulded fibre pulp, cardboard or fibre board made in conventional manner by moulding fibres deposited by paper-making techniques. These containers are lined with a plastics material which is capable of being heat-sealed to the lidding material but which is capable of withstanding the heat when the contents of the package are cooked or heated in a conventional gas or electric oven or in a microwave oven. The lining may be applied by vacuum forming, extrusion coating or laminating techniques.

Alternatively, the containers or trays may be made of a solid plastics material, such as a polyester or polysulphone, provided that the plastics material is capable of withstanding the heat when the contents of the package are cooked or heated in a conventional gas or electric oven or in a microwave oven. The lining may be applied by vacuum forming, extrusion coating or laminating techniques.

Alternatively, the containers or trays may be made of a solid plastics material, such as a polyester or polysulphone, provided that the plastics material is capable of withstanding the oven heat and can be heat-sealed to the lidding material.

The present package can be filled with frozen, chilled or fresh foods for subsequent heating in an oven or microwave oven and the foods may be packaged under gas-packaging or controlled atmosphere packaging technique. The present packages are easy to open even when hot and because the lid is not secured to the package by an adhesive, there is no risk that the adhesive may be adversely affected or dissolved by any liquid in the package which is of particular importance for chilled foods or that noxious fumes or odours will be generated by degradation of the adhesive under the conditions prevailing in an oven or microwave oven.

We claim:

1. A package comprising a container having a mouth of which is formed with a peripheral flange, the container including a layer of plastic material, and a lid which is heat-sealed to the flange of the container, comprising a tear-strip of material extending across at least the flange of the container and being secured to the lid by a heat-seal, with a portion of the tear-strip material being presented for engagement by the fingers of a user, the bond between the tear-strip and the lid being at least as strong as the bond between the lid and the flange.

2. A package as claimed in claim 1, wherein the lid and the tear-strip each comprise a layer of plastic material and a layer of a heat-seal material, and wherein the tear-strip is interposed between the lid and the flange in an A to B sealing mode.

3. A package as claimed in claim 1, wherein the lid is made of paper and the tear-strip is a strip of paper heat-sealed to the upper surface of the lid by the interposition of a layer of plastic material coated with a heat-seal material.

4. A package as claimed in claim 1, wherein the lid is made of paper and the tear-strip is a strip of paper to each side of which a layer of plastic material is adhered by a heat-seal material, and wherein the tear-strip is interposed between the lid and the flange.

5. A package as claimed in any one of claims 1 to 4, wherein the plastic material of the tear-strip and for the lid is a polyester, and the heat-seal material is an acrylic coating.

6. A package as claimed in any one of claims 1 to 4, wherein the plastic material of both the tear-strip and the lid is a polyester, and the heat-seal material is a coating of a different polyester.

7. A package as claimed in claim 5, wherein the polyester of the tear-strip and lid is polyethylene terephthalate.

8. A package as claimed in claim 1, wherein the tear-strip extends across the package.

9. A package as claimed in claim 6, wherein the polyester of the tear-strip and lid is polyethylene terephthalate.

* * * * *